US006384730B1

(12) United States Patent
Chen

(10) Patent No.: US 6,384,730 B1
(45) Date of Patent: May 7, 2002

(54) EYE-PROTECTIVE ALARM

(76) Inventor: Bing-Wen Chen, 4Fl., No. 11, Lane 228, Sung Ren Rd., Taipei (TW)

( * ) Notice: Subject to any disclaimer, the term of this patent is extended or adjusted under 35 U.S.C. 154(b) by 0 days.

(21) Appl. No.: 09/900,853

(22) Filed: Jul. 10, 2001

(51) Int. Cl.[7] ..... G08B 23/00

(52) U.S. Cl. ..... 340/573.1; 340/686.1; 340/691.5; 340/691.6; 340/693.5; 340/815.65; 340/815.69; 340/384.7

(58) Field of Search ..... 340/573.1, 573.7, 340/686.1, 691.1, 691.5, 691.6, 693.5, 815.65, 815.69, 384.7

(56) References Cited

U.S. PATENT DOCUMENTS 4,835,614 A * 5/1989 Ryu ..... 348/189
5,355,180 A * 10/1994 Back ..... 340/573.1

* cited by examiner

*Primary Examiner*—Daniel J. Wu
(74) *Attorney, Agent, or Firm*—Bacon & Thomas, PLLC

(57) ABSTRACT

Eye-protective alarm. When a user reads, writes or keys with a computer, the photosensitive resistor of the alarm can sense the illumination of the environment and detect insufficient safe visual distance and even detect too long working time and in time emit a warning music to inform the user of these situations. The eye-protective alarm includes a circuit structure including a system processor, illumination sensor, weak current detector, time controller, alarm informing circuit, light indicator module and several switches which are serially connected. The circuit structure via wires is connected to a cell box, an AC power socket and a distance sensor. The photosensitive resistor detects whether the illumination of the environment, safe visual distance and working time meet the preset standard values. If not, the system controller triggers the light indicator module and the alarm informing circuit to play the warning music so as to remind the user to improve these situations.

2 Claims, 5 Drawing Sheets

EYE-PROTECTIVE ALARM

BACKGROUND OF THE INVENTION

The present invention is related to an eye-protective alarm which is able to detect various kinds of situations harmful to eyes and emit different warning music so as to remind the user to improve these situations.

Sufficient illumination is important to people in reading or writing, especially to children. Also, a correct sitting attitude and watching time are important in protection of eyes. However, at present, there is no product capable of reminding a user to pay attention to these situations.

SUMMARY OF THE INVENTION

It is therefore a primary object of the present invention to provide an eye-protective alarm. When a user reads, writes or keys with a computer, the photosensitive resistor of the alarm can sense the illumination of the environment and detect insufficient safe visual distance and even detect too long working time and in time emit a warning music to inform the user of these situations and remind the user to improve these situations.

The present invention can be best understood through the following description and accompanying drawings wherein:

DETAILED DESCRIPTION, OF THE PREFERRED EMBODIMENTS

Figure 1:
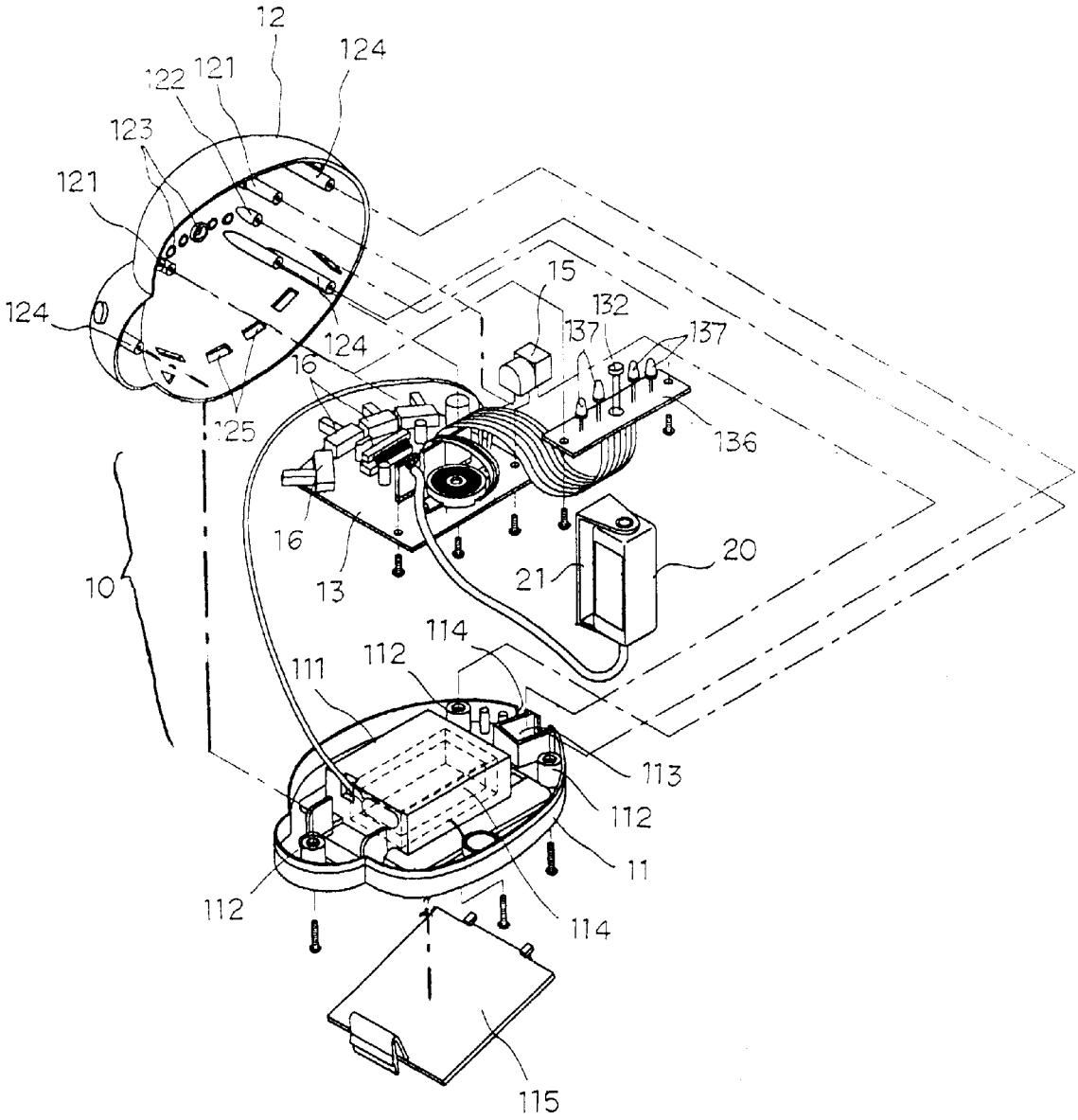
FIG. 1 is a perspective exploded view of the present invention.

Please refer to FIG. 1. The eye-protective alarm of the present invention includes a main frame 10 and a distance sensor 20.

Figure 2:
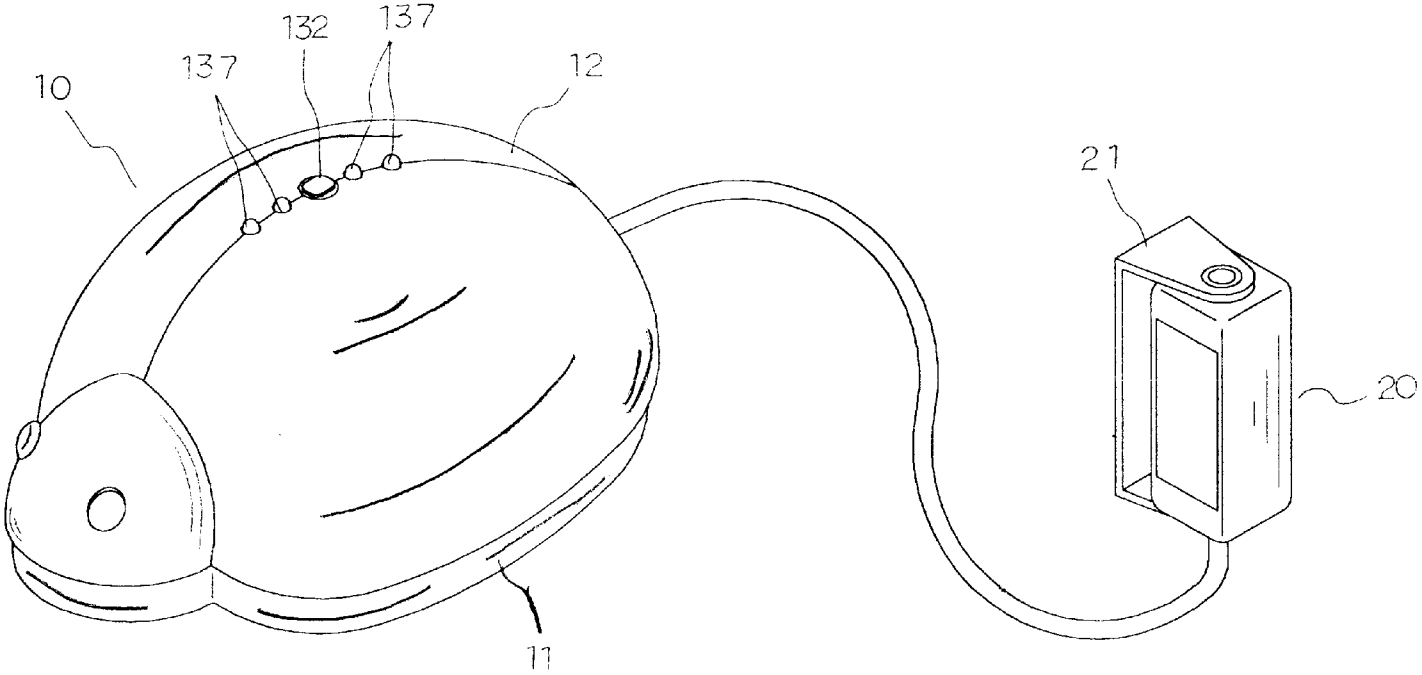
FIG. 2 is a perspective assembled view of the present invention.
Figure 3:
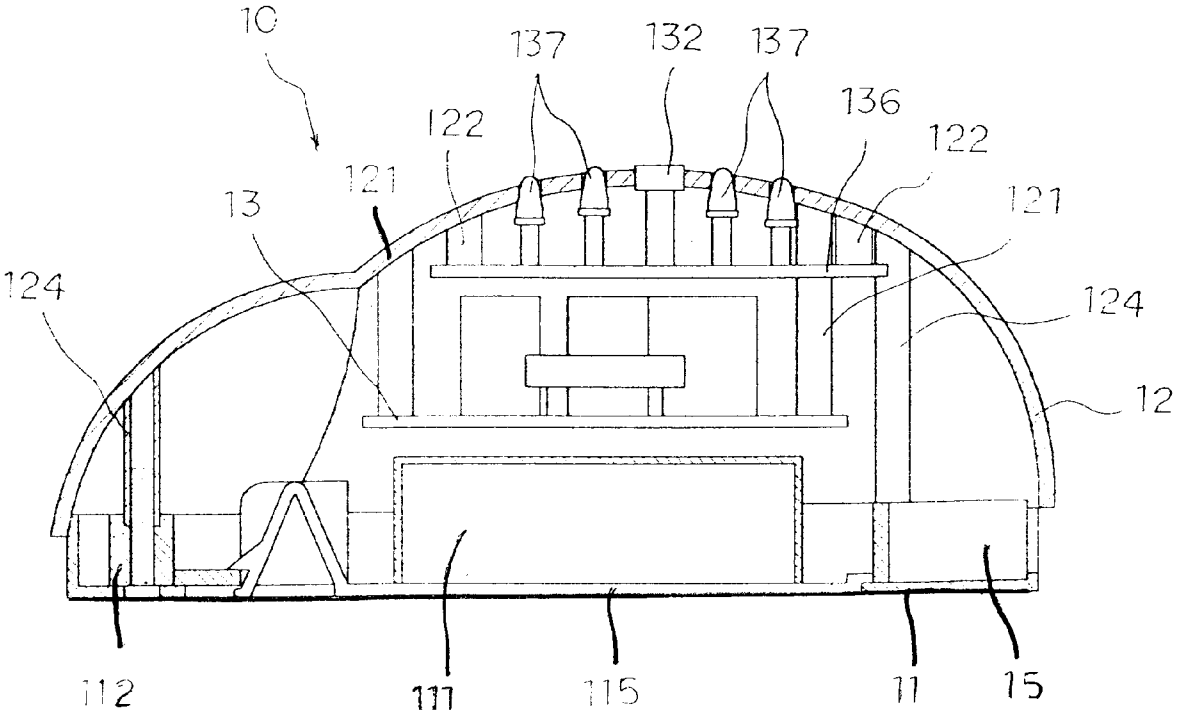
FIG. 3 is a sectional view of the present invention.

Referring to FIGS. 1 to 3, the main frame 10 is composed of a base seat 11 and an upper cover 12 which can have various patterns and mated with each other. A circuit structure 13 is inlaid between the base seat 11 and the upper cover 12. The center of the base seat 11 is formed with a rectangular recessed receptacle 111 in which a cell is disposed. Several locating posts 112 are arranged around the receptacle 111. One side of the base seat 11 is formed with a cavity 113 in which an AC power socket 15 is inlaid. A notch 114 is formed beside the cavity 113 for embedding therein a wire. The receptacle 111 is covered by a cover body 115. The upper cover 12 is designed with a certain pattern. The inner face of the upper cover 12 is formed with multiple projecting posts 121 at which the circuit structure 13 is located by screws. The center of the inner face is provided with a group of thread posts 122 and through holes 123 for connecting with a light indicator module 136. In addition, the periphery of the upper cover 12 is formed with multiple connecting posts 124 corresponding to the locating posts 112. Screws are screwed into the connecting posts and locating posts to firmly integrally connect the base seat 11 and the upper cover 12.

Figure 4:
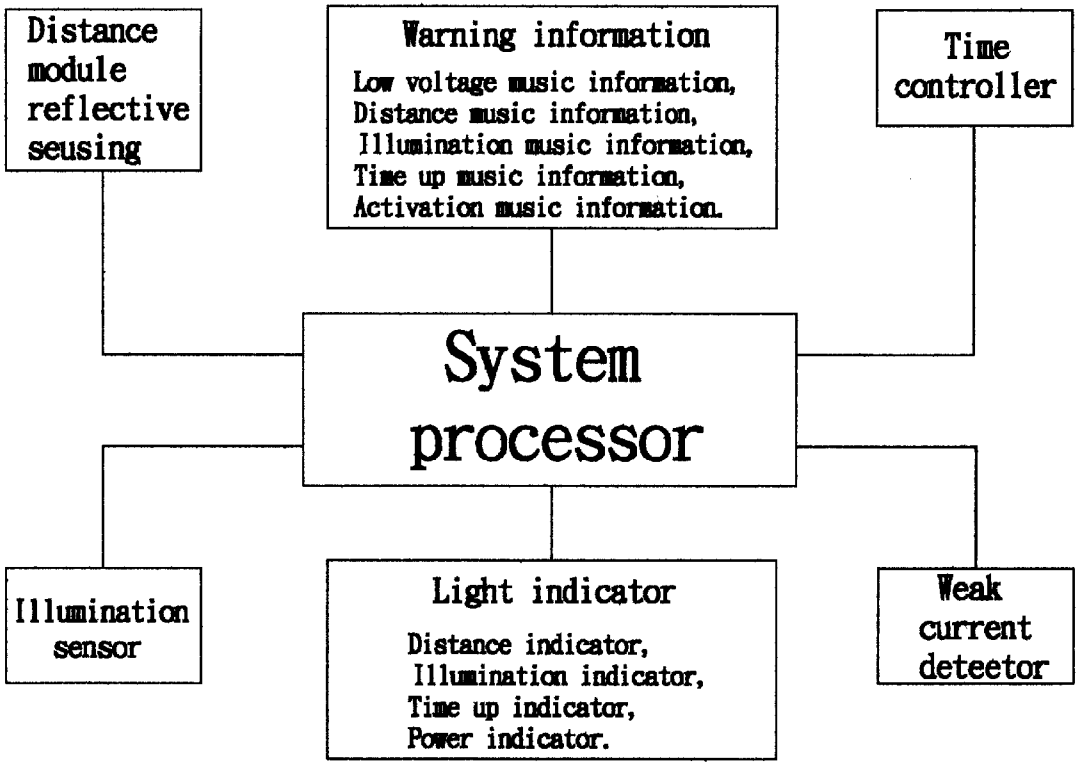
FIG. 4 is a block diagram of the present invention.

Referring to FIGS. 1 and 4, the circuit structure 13 includes a system processor 131, a photosensitive resistor 132, a weak current detector 133, time controller 134, alarm informing circuit 135 and light indicator module 136 which are serially connected. The circuit structure 13 via wires are connected to the cell 14 and AC power socket 15. The system processor 131 serves as a major controlling unit basically set with standard illumination value (about 330 ), safety distance value 50 cm, best working time value, etc. the photosensitive resistor 132 serves to sense the illumination of the environment and transmit the data to the system processor 131. The weak current detector 133 serves to detect the insufficiency of the power of the cell 14 and transmit the data back to the system processor 131. The time controller 134 can automatically set the working time of different stages. The alarm informing circuit 135 includes software IC capable of emitting several kinds of warning music, wave filter, oscillator and buzzer. The warning music includes music of insufficient distance, music of rest time and music of end of rest. The light indicator module 136 totally includes four light emitting diodes 137 with different colors to respectively indicate activation, distance detection, illumination sensing and time. The circuit structure 13 is further provided with four switches 16 respectively for powering on/off the circuit, detecting illumination, detecting safe distance and detecting time.

The distance sensor 20 via a wire is connected with the circuit structure 13. The distance sensor 20 has a movable seat 21 which can be freely turned. The back face of the movable seat 21 is provided with adhesive tape for fixing the distance sensor 20 at a desired position.

Figure 5:
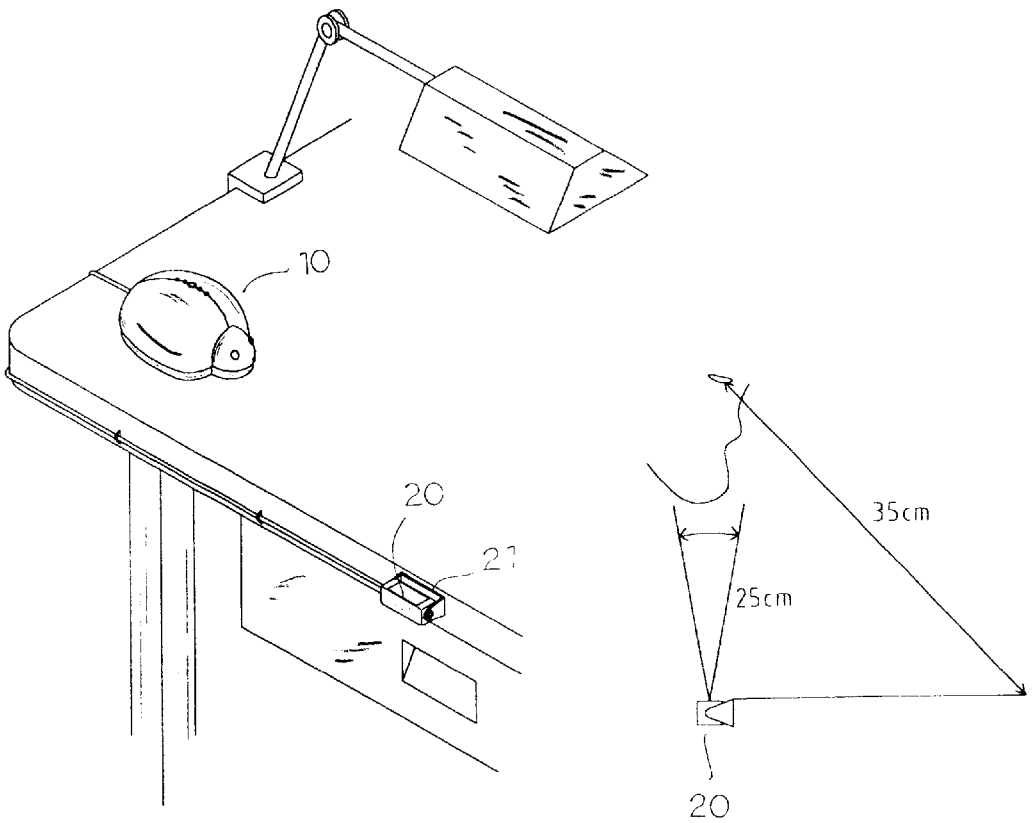
FIG. 5 shows the application of the present invention.

In use of the above structure, as shown in FIG. 5, the main frame 10 is placed on a desktop and the distance sensor 20 is fixed on an edge of the desktop facing a user. The distance sensor 20 is upward aimed at the chin of the user by a distance which is the standard distance of a right sitting attitude. The wire is tidily located by wire buckles. Accordingly, when the user sits in front of the desk and reads or write, in the case that the environment has insufficient illumination, the photosensitive resistor 132will sense the situation and transmit the information back to the system processor 131 which makes the alarm informing circuit 135 trigger the software IC to execute playing of the warning music through the buzzer for reminding the user of insufficient illumination of the environment. In the case that the user has an incorrect sitting attitude and the distance of straight sight between the eyes and the object is changed (exceeding preset standard distance), the distance sensor 20 will react in time and transmit the detected data back to the system processor 131. Also, the alarm informing circuit 135 trigger the software IC to play the music of insufficient distance to inform the user of incorrect sitting attitude which resulting in insufficient visual distance and remind the user to immediately improve such situation. Furthermore, when the user continuously sits in front of the desk and once the working time of stage preset in the time controller 134 is up, the data are immediately transmitted back to the system controller 131 to trigger the alarm informing circuit 135 to play the warning music of rest time so as to remind the user to stand up and take a rest. After the alarm again emits the warning music of the end of the rest, the user can go back to the desk for further working.

A 9V cell 14 can be installed in the receptacle 111 of the base seat 10 to internally supply DC power. Alternatively, via the AC power socket 15, the circuit structure 13 can be connected to external domestic AC power supply. In the case of the DC power of the cell 14, once the power is insufficient, the weak current detector 133 will sense this situation and the system processor 131 will trigger the alarm informing circuit 135 to play the warning music for reminding the user.

The eye-protective alarm of the present invention can in time emit different warning music with respect to insufficient visual distance, insufficient illumination and too long working time to remind a user to improve such situations. Accordingly, the eye-protective alarm of the present invention helps a user, especially a child to have a correct sitting attitude and protects the eyes of the user.

The above embodiments are only used to illustrate the present invention, not intended to limit the scope thereof. Many modifications of the above embodiments can be made without departing from the spirit of the present invention.

What is claimed is:

1. Eye-protective alarm comprising:

a main frame composed of a base seat and an upper cover which have various patterns and mated with each other, a circuit structure being disposed in the base seat, including a system processor, a photosensitive resistor, a weak current detector, time controller, alarm informing circuit and light indicator module which are serially connected, the circuit structure via wires being connected to a cell box and AC power socket the system processor serving as a major controlling unit for setting standard illumination value, safety distance value and best working time value, the photosensitive resistor serving to sense the illumination of the environment and transmit the data to the system processor, the weak current detector serving to detect the insufficiency of the power of the cell and transmit the data back to the system processor, the time controller automatically setting the working time of different stages, the alarm informing circuit including software IC capable of emitting several kinds of warning music, wave filter, oscillator and buzzer, the light indicator module totally including four light emitting diodes with different colors to respectively indicate activation, distance detection, illumination sensing and time, the circuit structure being further provided with four switches respectively for powering on/off the circuit, detecting illumination, detecting safe distance and detecting time; and a distance sensor via a wire connected with the circuit structure, the distance sensor having a movable seat which can be freely turned, the back face of the movable seat being provided with adhesive tape.

2. Eye-protective alarm as claimed in claim 1, wherein a 9V cell can be installed in the cell box of the circuit structure to internally supply DC power or via the AC power socket, the circuit structure can be connected to external domestic AC power supply.

* * * * *